United States Patent [19]

Nagata et al.

[11] 4,390,388

[45] Jun. 28, 1983

[54] AUTOMATIC SPLICER IN TAPE FEEDER OR THE LIKE

[75] Inventors: Takao Nagata, Fujisawa; Yoshiyuki Rokutanbo, Yokohama, both of Japan

[73] Assignee: Nippon Jidoh Seiki Kabushiki Kaisha, Yokohama, Japan

[21] Appl. No.: 267,409

[22] Filed: May 26, 1981

[30] Foreign Application Priority Data

Mar. 25, 1981 [JP] Japan ..... 56-043357

[51] Int. Cl.[3] ..... B65H 19/18; B65H 69/06

[52] U.S. Cl. ..... 156/351; 156/361; 156/378; 156/504; 156/505; 242/58.4; 242/58.5

[58] Field of Search ..... 156/157, 159, 502, 504, 156/505, 351, 361, 378; 242/58.1, 58.4, 58.5; 250/548

[56] References Cited

U.S. PATENT DOCUMENTS

| | | | |
|---|---|---|---|
| 3,730,811 | 5/1973 | Wendt | 156/505 |
| 3,783,293 | 1/1974 | Gold et al. | 250/548 |
| 4,067,760 | 1/1978 | Nelson | 156/159 |
| 4,116,399 | 9/1978 | Mosburger et al. | 156/504 |
| 4,157,934 | 6/1979 | Ryan et al. | 156/504 |
| 4,169,752 | 10/1979 | Tokuno | 242/58.4 |
| 4,284,463 | 8/1981 | Wright | 156/504 |

*Primary Examiner*—Michael G. Wityshyn

[57] ABSTRACT

This tape splicer makes it possible to splice tapes having patterns, colors, characters, figures printed repeatedly thereon in a predetermined pitch and containing in the patterns distinct printed or non-printed zone patterns having gaps of a specific length within one pitch in the longitudinal direction, while effecting the exact coincidence of the patterns on the trailing end portion of the preceding tape with those on leading end portion of the succeeding tape not only in the direction of width but also in the direction of length of the tapes, while the tape feed is being continued, without stopping the tape feeding machine.

7 Claims, 10 Drawing Figures

AUTOMATIC SPLICER IN TAPE FEEDER OR THE LIKE

BACKGROUND OF THE INVENTION

The present invention relates to a tape splicer in a machine for continuously and automatically feeding tapes or tubes, which have patterns, colors, characters, figures or the like (hereinafter referred to as "patterns") printed repeatedly thereon, for use in packaging, for example, which makes it possible to splice old and new tapes with the tape patterns correctly positioned, while the tape feed is being continued, without stopping the tape feeding machine.

The tape or tube is wound cylindrically and loaded onto a reel. The tape is then rewound and fed from the reel, and the tape feed is generally finished within about ten minutes. Then the old tape is replaced with a new one and the tape feed is continued.

Replacement of the old has conventionally been effected by stopping the tape feeding machine, setting the leading end portion of the tape from the new reel to the tape feed path, and starting the operation of the tape feeding machine again. The time required for the replacing operation requires about 1/10 to 1/5 of the machine operation time, so that, for example in a machine operation time of 10 hours, the machine has to be stopped for one to two hours, resulting in lowered production.

The abovementioned problem would be completely eliminated if the splicing of old and new tapes could be accomplished during continuous tape feeding machine operation.

A heretofore known technique of this kind of automatic paper splicing in a rotary press of newspaper is known. In this case, however, since the tape to be fed is white and blank it has an infinitely wide allowance for the splicing positions of the old and new tapes, so that the tapes can be spliced at arbitrary positions in their longitudinal direction.

However, tapes such as in labels or tubes for packaging often bear trademarks, names of manufacturer, lists of ingredients or components, and the like (hereinafter referred to as "patterns") printed repeatedly on the tape surface with a predetermined pitch, and these tapes are to be later cut in predetermined gaps after they have been continuously and automatically fed through the tape feeding machine. Hence, it is an essential requirement that the splicing positions of the old and new tapes be such that the printed patterns be always positioned perfectly with one another not only in the direction of width of the tapes, but also in their longitudinal direction. If the tapes are spliced with incorrect positioning, they will be cut at positions other than the predetermined cutting position in a subsequent cutting stage, whereby the intermediate portion of the repeated printed displays will be cut in the same way as a clumsy television picture occurring when the vertical syncronization is out of order, and the tapes can then no longer be used as a product.

As means for splicing tapes having a pattern printed repeatedly thereon with a predetermined pitch, there is known a method which disposes zone patterns, at optional positions in the longitudinal direction of the tapes, which have eye marks instead of within the zones so that the pitch can be detected via the to marks realize an exact correspondence of both sheets in the longitudinal direction.

When these tapes are employed as packaging material also to be used as advertising media, however, the blank portions provided with the eye marks for pitch detection serve only as the splicing marks for the old and new tapes but are of no use at all as advertising media.

SUMMARY OF THE INVENTION

It is therefore an object of the present invention to provide a tape splicer for splicing the old and new tapes, which splicer makes it possible to splice the tapes together while effecting the exact coincidence of the patterns on the trailing end portion of the preceding tape with those on the leading end portion of the succeeding tape not only in the direction of width but also in the direction of length of the tapes, without stopping the operation of a tape feeding machine, and thus to markedly improve the production efficiency.

It is a second object of the present invention to provide a tape splicer which completely elimates eye mark zones with no pattern which serve only for the splicing of old and new tapes, which splicer is capable of reading the printed patterns of advertising media and effecting the exact coincidence of the patterns in the longitudinal direction of the old and new tapes using the printed patterns themselves as the reference and splicing the tapes together, and which splicer provides the tapes with outstanding advertising effects.

The construction of the present invention may be summarized as follows.

(1) First, in advance, in the printing of the patterns having a predetermined pitch in the longitudinal direction of the tape, a zone pattern having a gap of a specific length in the longitudinal direction is included in the abovementioned pattern.

(2) A pair of paths are disposed, the paths capable of feeding alternately each tape in a suitable quantity from a pair of reels supporting thereon rolls of the tapes to a common feed roller.

(3) First and second photoelectric conversion switches are disposed at positions inside the abovementioned paths upstream of an equidistant from the feed roller so that a main motor and motor for driving the abovementioned feed roller are changed over to low speed revolution by means of output signals from these switches and at the same time, a pulse generator is actuated to generate pulses in such a number as to correspond to the rotational displacement of the feed roller.

(4) A pair of tape holding plates are disposed at intermediate positions in the abovementioned pair of paths in order to draw and hold the leading end portion of the succeeding tape in a waiting state.

(5) A third photoelectric conversion switch for detecting the patterns of the tape is disposed immediately before the feed roller, and an ON-OFF signal produced from this switch and the pulse number generated from the abovementioned pulse motor are supplied to a first counter so that the first counter produces one signal whenever it counts the number of pulses corresponding to one pattern zone. This output signal is then supplied to a second counter so that when the first counter output number equals the pitch number corresponding to the distance between the set position of the first or second photoelectric conversion switch and the set position of the aforementioned pair of tape holding plates are counted by the second counter, this counter generates a signal instructing a stop of the revolution of the feed roller to thereby stop the trailing end portion of the preceding tape within the tape holding plates and at the same time, it also generates a signal instructing to advance and join the pair of tape holding plates so that the old and new tapes are pressed together and bonded to each other by a flap applied with an adhesive that has been bonded in advance to the leading end portion of the succeeding tape.

(6) When the feed roller stops rotating, the stored tape is continuously fed in the downstream direction by means of a rocking roller storing the tape, disposed downstream of the feed roller. The rocking roller is suspended by the tape stretched between a pair of guide rollers, and rises against its own weight when tension is applied to the tape.

(7) Thus, in a state where the operation of the tape feeding machine is kept continuous, the exact coincidence of the patterns in the longitudinal direction of the old and new tapes is effected, thereby splicing of these tapes is perfect.

In addition to the abovementioned construction, the present invention is also characterized in that:

(8) The suction holding plate of the leading end portion of the succeeding tape is detachably fitted to its support in order to further improve the accuracy of fitting and locating operations of the leading end portion of the succeeding tape to the surface of the suction holding plate, to further perfect the exact coincidence of the tapes when they are spliced.

BRIEF DESCRIPTION OF THE DRAWINGS

The accompanying drawings illustrate embodiments of the present invention in which.

DESCRIPTION OF THE PREFERRED EMBODIMENTS

Hereinafter, embodiments of the present invention will be described in detail with reference to the accompanying drawings.

Figure 2:
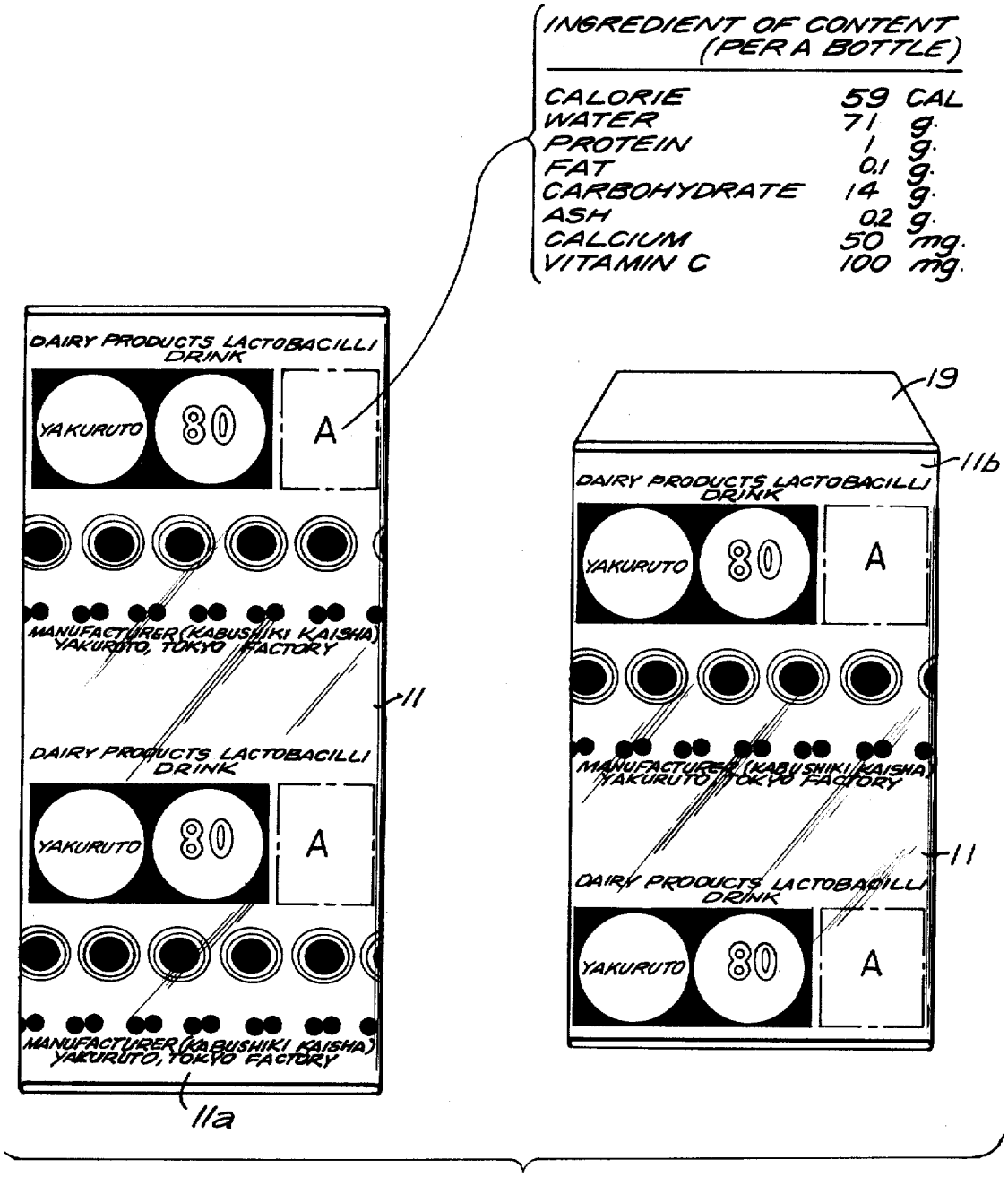
FIG. 2 is a schematic view showing the relationship between the trailing end portion of a preceding tape and the leading end portion of a succeeding tape at the time of splicing.
Figure 8:
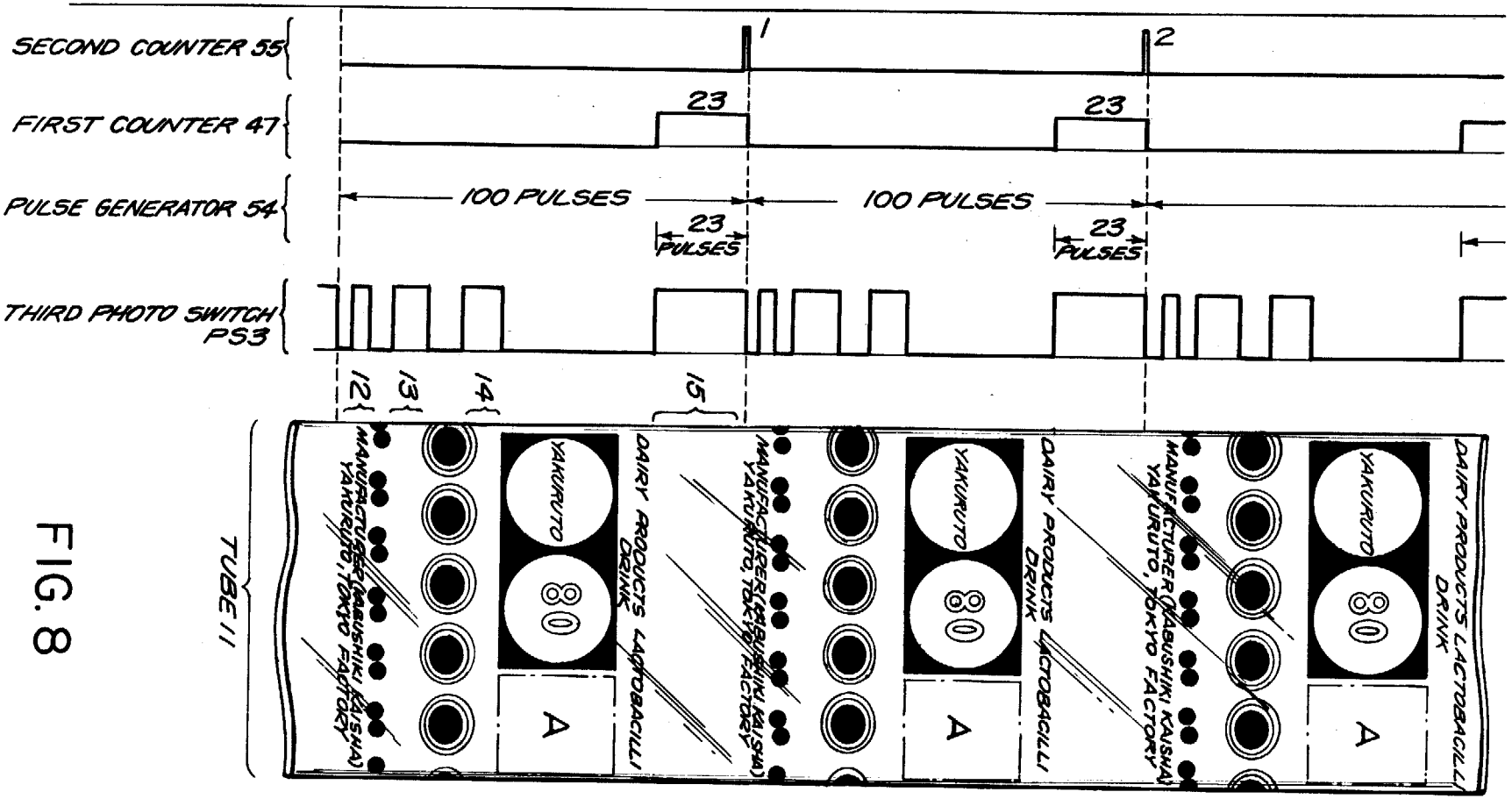
FIG. 8 is a schematic view useful for explaining an example of a pulse count control for stopping the trailing end of the preceding tape after permitting it to move from its detected position to the splicing position.

The tapes that are to be spliced in accordance with the present invention include not only tapes of ordinary tapes but also a flatly crushed tube 11 of a transparent material, such as shown in FIGS. 8 and 2, for example. The same patterns are printed so as to appear repeatedly on this tube 11 in a pre-determined pitch in the longitudinal direction, every 78 mm in this example, and the range of printing extends over the entire circumference of the tube 11. The contents of the printing represent the origin of the product and enhance the advertising effects. In this example, the name of the product, the trade mark, the name and address of the factory of the manufacturer, the list of ingredients or components of the product and colors and patterns for visualizing them, are printed in intransparent ink. However, neither a blank zone nor an eyemark having a predetermined width is printed in the longitudinal direction at all.

However, in the tube of this embodiment, four kinds of non-printed zones 12, 13, 14 and 15 (FIG. 8) are disposed in one pitch along the direction of width between various patterns, and the lengths of these zones in the longitudinal direction of the tube are 3 mm, 7 mm, 7 mm and 18 mm, respectively. In this embodiment, the zones 12, 13 and 14 are not used, and only zone 15 with a length of 18 mm is being used as a distinction pattern for splicing.

Figure 1:
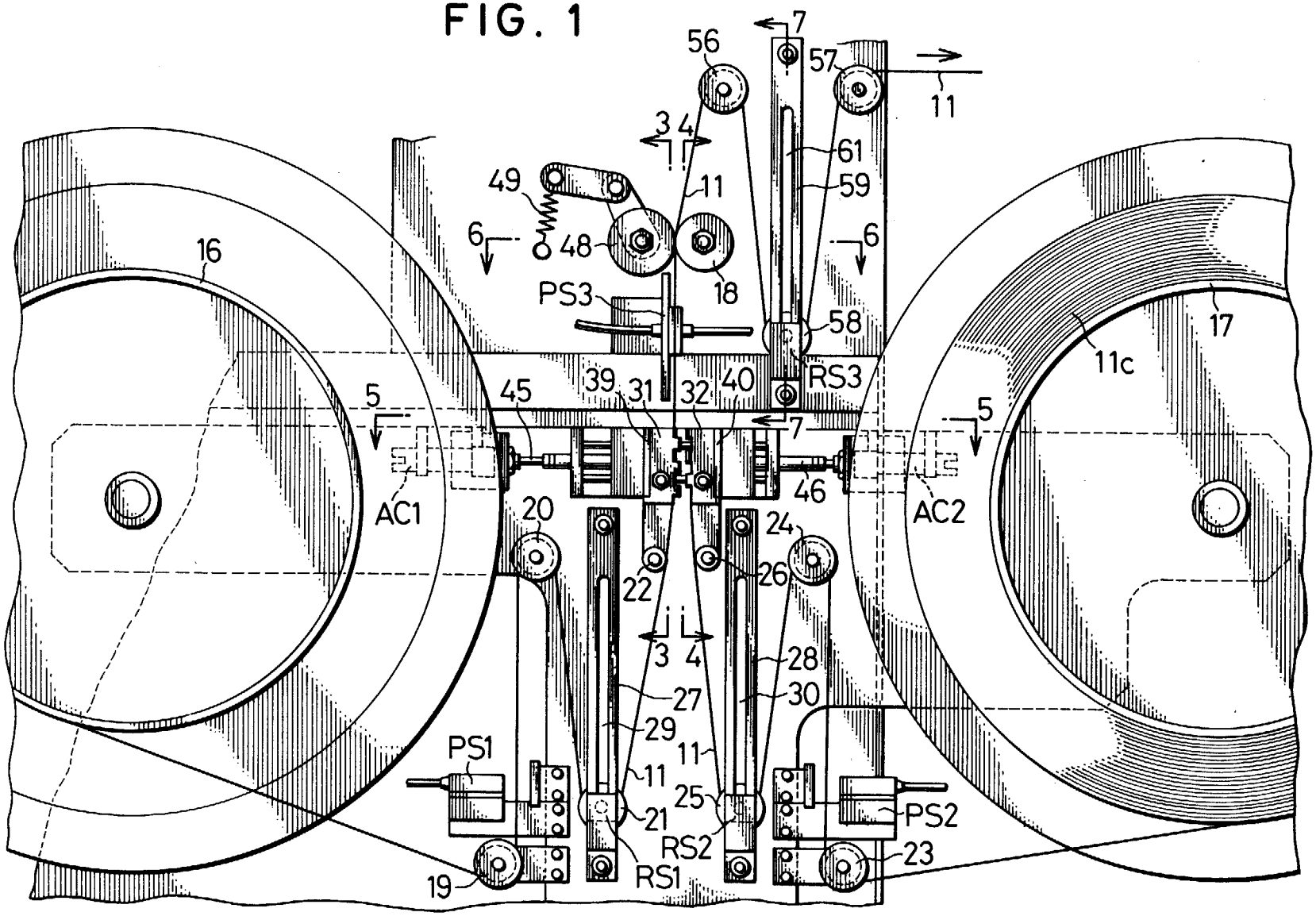
FIG. 1 is a plan view of an automatic splicer.

The tube 11 thus containing the particular distinction pattern within one pitch is shaped into rolls 11*c* as shown in FIG. 1 and loaded onto each of a pair of right and left reels 16, 17. These reels are alternately fed to a common feed roller 18 and the splicing operation becomes necessary at the time of replacement of old and new tubes. In the embodiment shown, the tube 11 fed from the lefthand reel 16 precedes, followed by the tube 11 fed from the right-hand reel 17. Accordingly, the trailing end portion 11*a* of the preceding tube on the left and the leading end portion 11*b* of the succeeding tube are spliced mutually as shown in FIG. 2. A splicing flap 19 with an adhesive applied on one side is bonded in advance to the leading end portion 11*b* of the succeeding tube.

The tubes 11 fed out from the right and left reels are guided towards the common feed roller 18 along respective feed paths passing through guide rollers 19, 20, 21, 22 and 23, 24, 25, 26 that are disposed symmetrically to one another.

Figure 9:
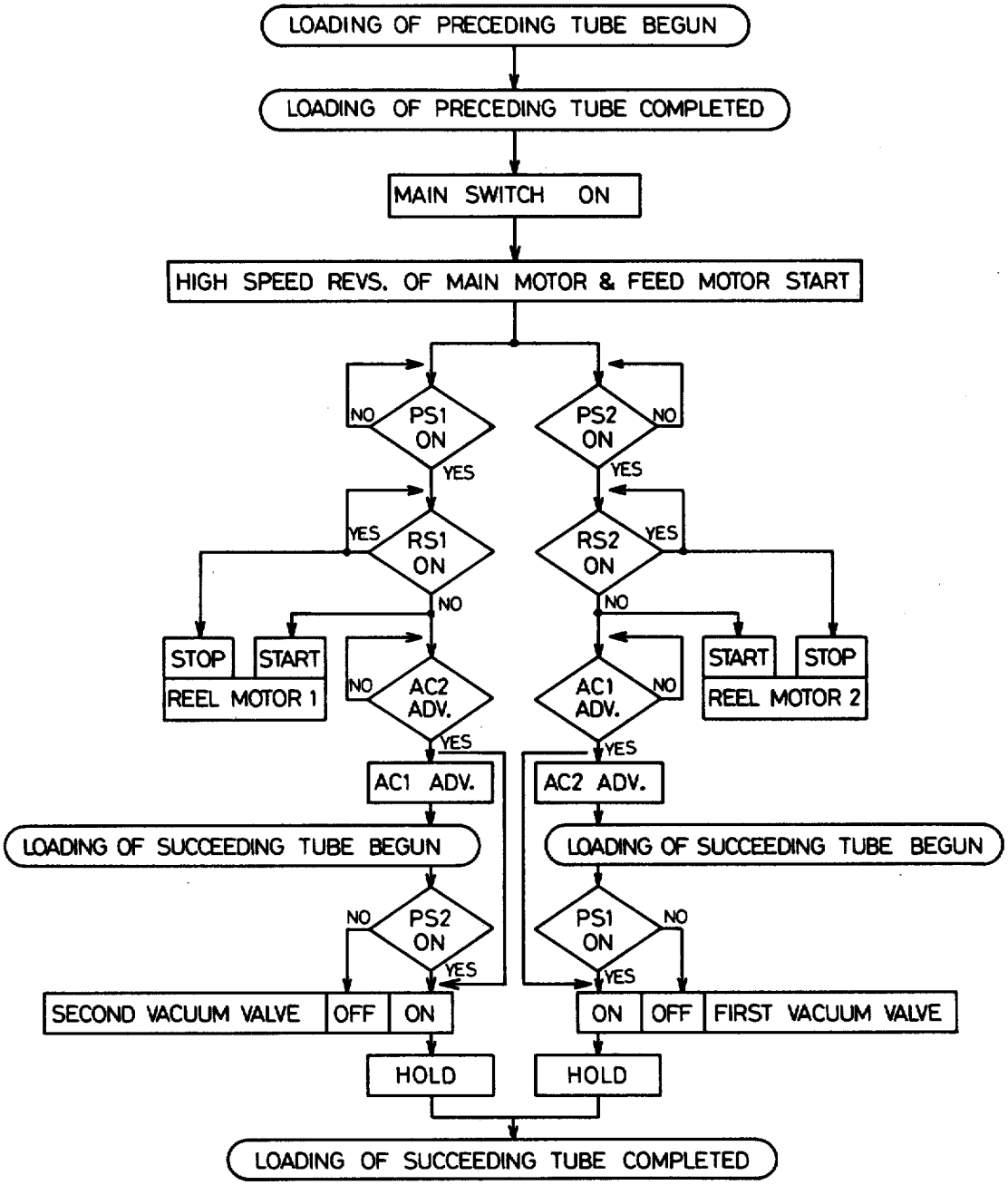
FIG. 9 is a flow chart useful for explaining the loading operation of the succeeding tape for splicing.

Among the abovementioned guide rollers, the rollers 21 and 25, disposed between the pairs of rollers 20, 22 and 24, 26, respectively, and suspended by the tubes being fed, are disposed in order to prevent the tubes from sagging when they are fed excessively, and thus ensure a constant supply of the tubes in appropriate amounts. Both axial end portions of each roller 21, 25 are supported movably in the vertical direction by slits 29, 30 of guide frames 27, 28, fixed in the vertical direction. Proximity switches RS1 and RS2 are disposed at the lower limit positions of these rollers so that when a roller reaches its lower limit, the switch RS1 and RS2 closes ("YES"), stopping the reel motor 1 or 2 (see FIG. 9) or disengaging the clutch of its driving system. When the tension of the tubes is thus allowed to act upon the rocking rollers 21 and 25 and one of these rollers rises, one of the proximity switches RS1 or RS2 is opened ("NO"), thereby starting the reel motor 1 or 2 or engaging the clutch of its driving system, so the tube is fed out from its reels. When the feed quantities of the tube become excessive and the tube sags down thereby to lower the rocking roller 21 or 25 to its lower limit position, the feed of the tube is automatically stopped by the abovementioned operation of the proximity switches RS1 and RS2. In this manner, the feed of the tubes in appropriate quantities is constantly ensured, and excessive or insufficient tube feed is automatically prevented.

In the abovementioned pair of right and left tube feed paths, first and second photoelectric conversion switches PS 1 and PS 2 are disposed in positions upstream of and equidistant from the feed roller 18 in order to detect the passage of the trailing end portion of the preceding tube.

Figure 3:
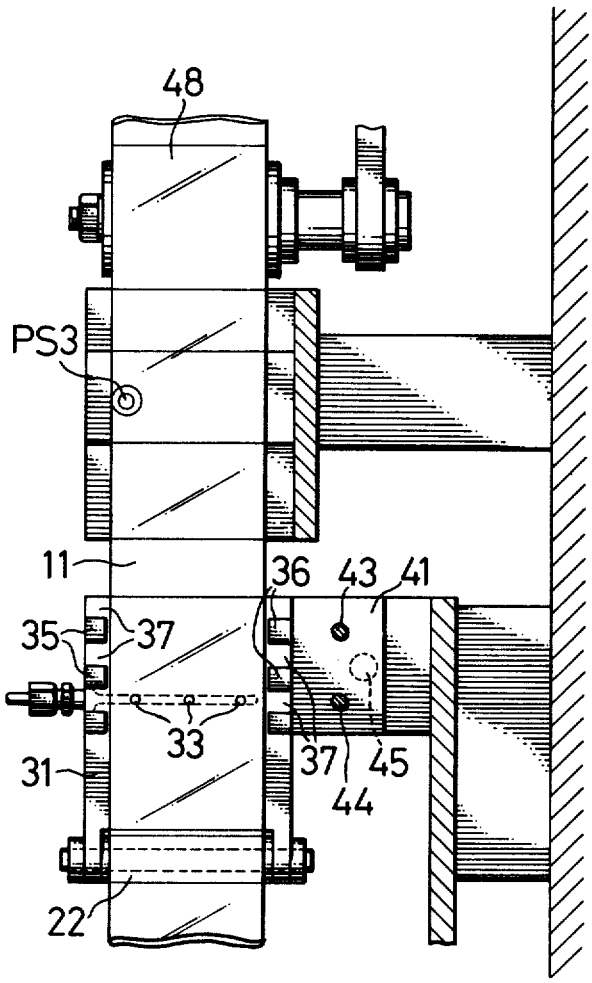
FIG. 3 is an enlarged longitudinal sectional right side view taken along line 3—3 of FIG. 1.
Figure 4:
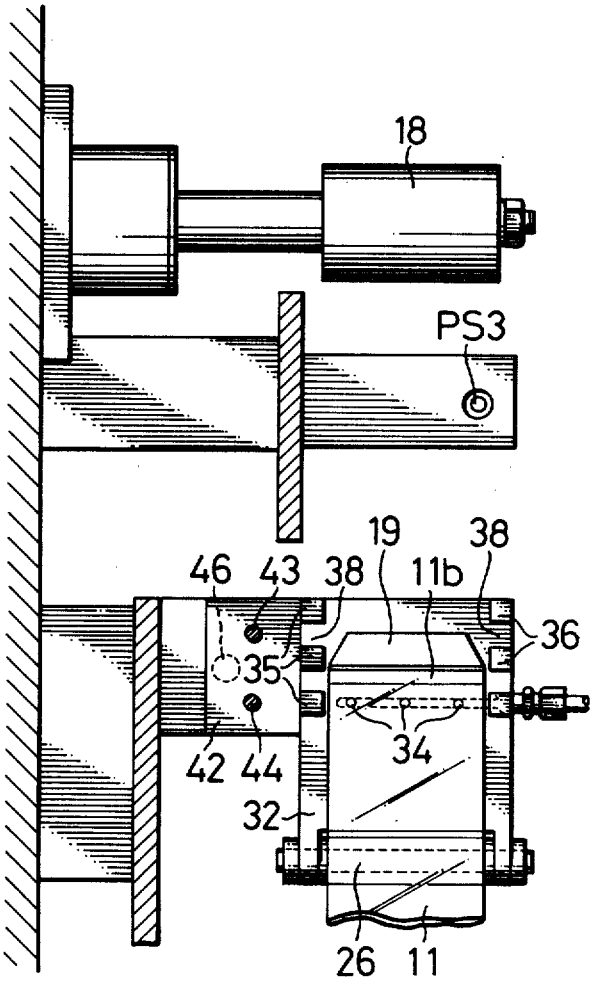
FIG. 4 is an enlarged longitudinal sectional left side view taken along line 4—4 of FIG. 1.

Outside each feed path between each photoelectric conversion switch and the feed roller 18, there are disposed a pair of tube holding plates 31 and 32. Negative pressure suction holes 33, 34 are bored on the front surface of each plate (see FIGS. 3 and 4) so that the leading end portion of the succeeding tube is held by suction on the plate upon the opening of first and second vacuum valves (see FIGS. 9 and 10) as shown in FIG. 4.

Location of the tip of the tube with respect to the plate surface in the direction of width is effected by means of protuberances 35 and 36 juxtaposed at the right and left ends of the plate surface, and location in the longitudinal direction is effected by visual estimation with reference to the change in flatness which is substantially uniform and which occurs due to recesses 37, 38 interposed between the protuberances.

The abovementioned pair of tape holding plates 31, 32 are provided on their backs with detachable brackets 39, 40, respectively, that are fixed in turn to a pair of slider blocks 41, 42, respectively. Each slider block is guided by common guide rods 43, 44 and is so fitted as to be capable of being displaced to the right or left. Furthermore, these slider blocks 41, 42 are fitted to the tip portions of rods 45, 46 of the piston rods 45, 46 of a pair of air cylinders AC1 and AC2, respectively.

In FIG. 1, the air cylinder AC1 is shown placed at its advanced position, with the other AC2 at its withdrawn position. In this state, when the right-hand air cylinder AC2 is advanced, the pair of tube holding plates 31 and 32 are pressed together.

Symbol PS3 represents a third photoelectric conversion switch that is disposed immediately before the feed roller 18 so as to interpose the tube 11 from the right and left. As shown in FIG. 8, this switch detects the transmission or interception of light by the patterns printed on the tube 11, and its ON-OFF signal is supplied to a first counter 47.

A press roller 48 is constantly pressed against the feed roller 18 by the action of a spring 49, and the tube 11 is being fed while interposed between the pair of these rollers.

Figure 6:
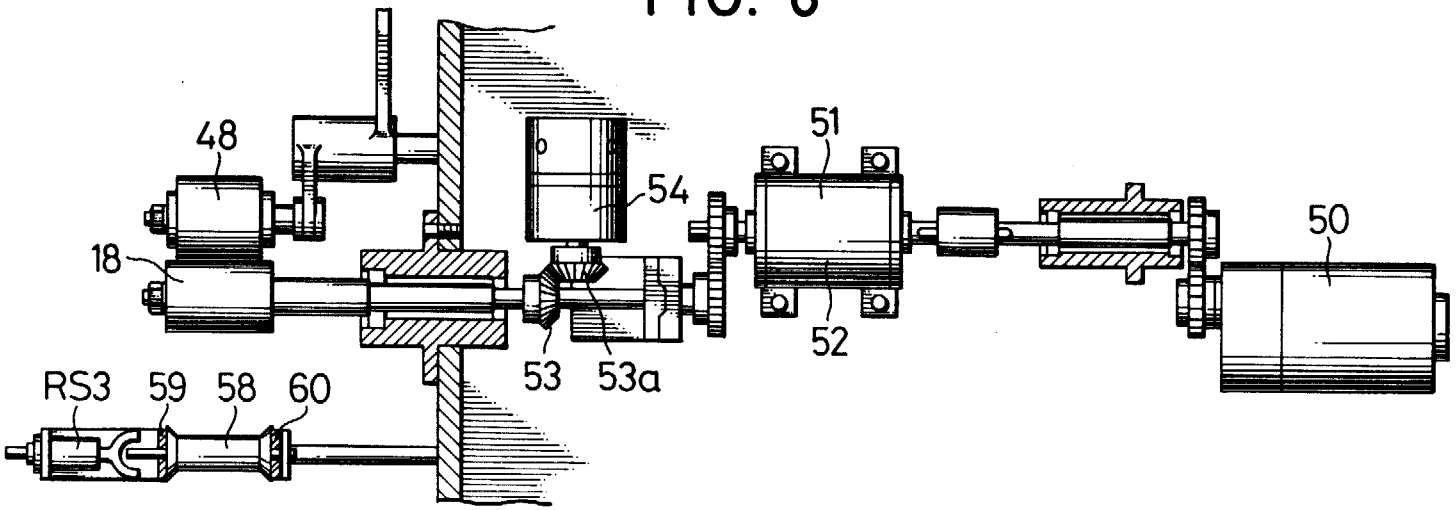
FIG. 6 is a transverse sectional plan view taken along line 6—6 of FIG. 1.

As shown in FIG. 6, the feed roller 18 is driven by a feed motor 50, an electromagnetic clutch 51 and a brake 52 are disposed at an intermediate position of the driving power transmission system between the feed roller and the motor. A pulse generator 54, rotated via bevel gears 53 and 53*a*, is disposed at an intermediate position of the driving system between the roller 18, the clutch 51, and the brake 52.

The feed roller driving motor 50 and a main motor not shown are ordinarily rotating at high speed. However, these motors are changed over to a low speed rotation of about 1/10 the high speed upon receiving an input signal generated upon the detection of the trailing end portion of the preceeding tube by the first or second photoelectric conversion switch PS1 or PS2. These motors are released from the low speed rotation by a signal which is generated along with the withdrawal of the tape holding plates 31 and 32 when the tape splicing operation is completed, and resume their ordinary high speed rotation.

The pulse generator 54 is actuated upon receiving the signal generated from the first or second photoelectric conversion switch PS1 or PS2 and generates a number of pulses proportional to the rotational displacement of the feed roller 18. If the 78 mm length of one pitch of the tube 11 is converted into a pulse number, it can, for example, be represented by 100 pulses as shown in FIG. 8.

The first counter 47 receives the pulse number generated from the pulse generator 54 and the ON-OFF signal detected from the third photoelectric conversion switch PS3 and produces one signal whenever a pulse number 23 corresponding to the gap of the aforementioned particular distinction pattern 15 is counted.

The second counter 55 receives the signal generated from the first counter 47 and generates two kinds of signals. The first instructs the electromagnetic brake 52 to stop the revolution of the feed roller 18 when the number of pitches of the repeated printed patterns corresponds to the distance between the set positions of the first or second photoelectric conversion switch PS1 or PS2 and, the set position of the aforementioned pair of tape holding plates 31, 32, 10 pitches in this example. The second instructs the advance and coupling of the pair of tape holding plates 31, 32.

Figure 7:
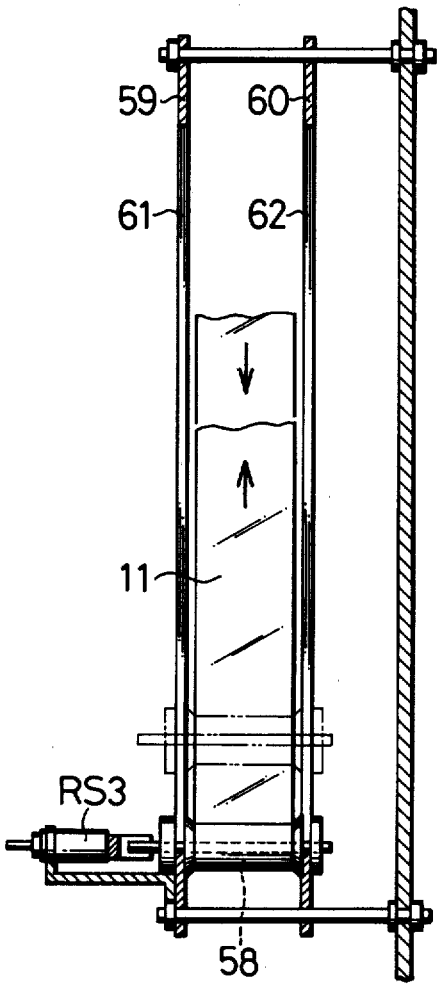
FIG. 7 is an enlarged longitudinal sectional right side view taken along line 7—7 of FIG. 1.

As shown in FIGS. 1, 6 and 7, a third, suitable quantity feed mechanism for the tube is disposed downstream of the feed roller 18. This mechanism normally functions to prevent excessive or insufficient feed of the tube but at the time of splicing the new and old tubes together, the mechanism continues to feed the stored tape downstream when the feed roller 18 has stopped rotating for splicing the old and new tapes, so that the tube is constantly fed to a tube cutting step (not shown), which is under the control of the main motor now rotating at the low speed.

The construction of this mechanism is as follows. Rocking roller 58 is suspended by the tube 11 between a pair of guide rolls 56, 57, and a shaft projecting from both ends of the roller 58 is supported movably in the vertical direction by slits 61, 62 in guide frames 59, 60 that are fixed in the vertical direction, and a proximity switch RS3 is disposed at the lower limit position of the roller.

Normally, the proximity switch RS3 is closed at the lower limit position of the rocking roller 58 and the electromagnetic brake 52 operates, thereby stopping the revolution of the feed roller 18. On the other hand, as the tube 11 is pulled, the rocking roll 58 rises and the proximity switch RS3 is opened so that the electromagnetic clutch 51 engages to transmit the high speed revolution to the feed roller 18. Hence, quick feed of the tube 11 is possible.

Figure 10:
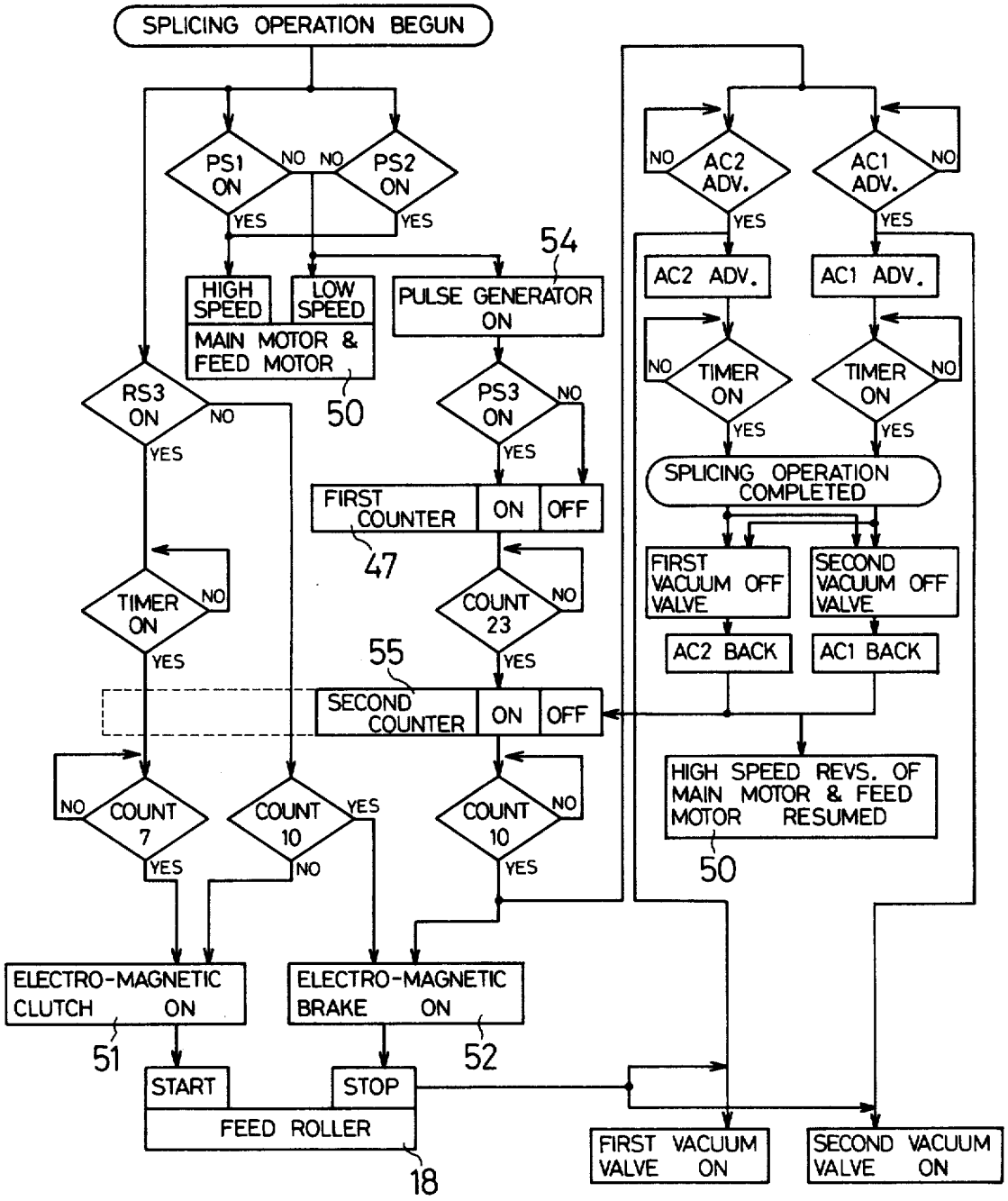
FIG. 10 is a flow chart useful for explaining the splicing operation between the new and old tapes.

As shown in FIG. 10, however, the splicing operation is initiated when the first or second photoelectric conversion switch PS1 or PS2 detects the trailing end portion of the preceding tube. Accordingly, the main motor and feed motor 50 are changed over to the low speed. In the interim, when the rocking roll 58 rises and thereby opens ("NO") the proximity switch RS3, the electromagnetic clutch 51 keeps engagement and transmits the low speed revolution to the feed roller 18 unless the counting of the second counter 55 reaches the number of pitches corresponding to the distance between the detection and joining locations, or 10 in this example. When the counting reaches 10, the revolution of the feed roller 18 may be stopped. If the rocking roll 58 undergoes displacement to its lower limit in the interim, the revolution of the feed roller 18 would normally be stopped. In the abovementioned case, however, even if the proximity switch RS3 is closed ("YES"), the electromagnetic clutch 51 is kept engaged even if the counting of the second counter 55 has only reached, say 7, so that the feed roller 18 is kept rotating so the feed of the end of the preceding tube 11*a* is completed.

The operation of the tape splicer of the present invention is as follows.

Referring to FIG. 1, either one of the tube feed paths may be the leading side. The left side is used in this example. Before the driving of the tape feeding machine is started, the preceding tube 11 is pulled out from the reel 16 on the left and is extended to the cutting step, not shown, to complete loading through the guide roller 19, the first photoelectric conversion switch PS1, the guide roller 20, the first rocking roller 21, the guide roller 22 and the pair of tube holding plates 31, 32, through the third photoelectric conversion switch PS3, the feed roller 18 and the press roller 48, and through the guide roller 56, the third rocking roller 58 and the guide roller 57. When the main switch is then turned on, the main motor and the feed motor start rotating at a high speed and the tube 11 starts being fed rapidly. The tension of the tube 11 acts upon the first rocking roller 21 and the third rocking roller 58 and the rollers start rising from their lower limit positions, whereby the proximity switches RS1 and RS3 are actuated, respectively, thereby engaging the power transmission clutch of the reel motor not shown and the power transmission clutch 51 of the feed motor 50. Consequently, the tube 11 is fed in the downstream direction. When the rocking rollers lower to their lower limit positions, the feed of the tube 11 in the downstream direction is stopped. This intermittent feed of the tube is repeated thereby to constantly feed an appropriate quantity of the tube 11.

Figure 5:
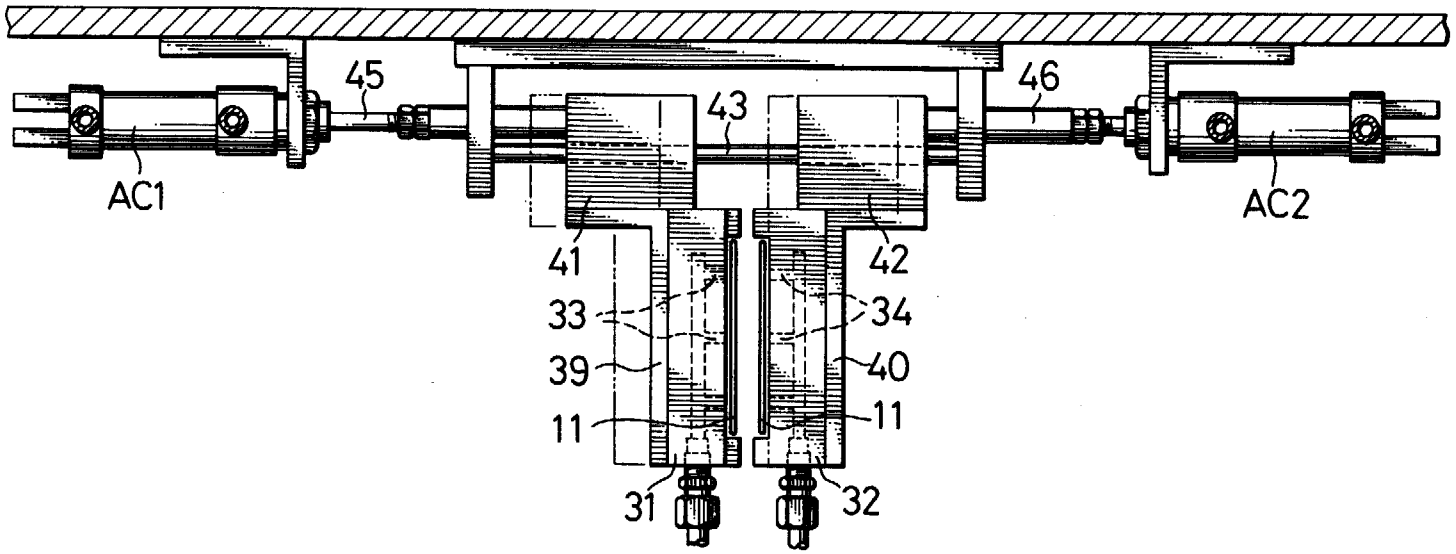
FIG. 5 is an enlarged transverse sectional plan view taken along line 5—5 of FIG. 1.

Incidentally, before initiating the operation of the tape feeding machine, the right and left air cylinders AC1 and AC2 are at their withdrawn positions. When the first proximity switch RS1 is opened ("NO"), the left-hand air cylinder AC1 is allowed to advance after the right-hand air cylinder AC2 is confirmed to be at its withdrawn position (see FIGS. 1, 5 and 9).

In order to load the tube 11, that is wound on the right-hand reel 17, into the feed path, the leading end portion of the tube is pulled out from its reel 17 and is passed through the second photoelectric conversion switch PS2 via the guide roller 23, whereby the switch is actuated ("YES") and the second vacuum valve is opened ("NO") so that the vacuum will be created in the tube suction holes 34 bored on the front surface of the right-hand tube holding plate 32. In this instance, the leading end portion of the succeeding tube 11 is brought to the right-hand tube holding plate 32 via the guide roller 24, the rocking roller 25, and the guide roller 26, and is held in a predetermined position on its front surface by vacuum thus completing the loading of the splicing tube (see FIG. 4). Prior to this loading operation, a flap 19 applied with an adhesive has been bonded to the leading end portion 11*b* of the succeeding tube 11.

The automatic splicing operation between the trailing end portion of the preceding tube and the leading end portion of succeeding tube is effected in the following manner. When the first photoelectric conversion switch PS1 is opened ("NO") due to the passage of the trailing end portion of the preceding tube therethrough, its signal is supplied to the main motor and to the feed motor 50 so that the speed of revolution of these motors is changed over to a low speed of about 1/10 of the normal speed and at the same time, the signal is also applied to the pulse generator 54 to actuate the same. The pulses from the pulse generator 54 and the ON-OFF signal from the third photoelectric conversion switch PS3 are supplied to the first counter 47. Whenever the counter 47 counts the number of pulses 23 corresponding to the gap between the specific distinction patterns 15, it generates one signal to the second counter 55. When the second counter 55 counts 10 pitches of the tube 11, corresponding to the difference of distance in this example between the set position of the first photoelectric conversion switch PS1 and the set positions of the pair of tube holding plates 31, 32, it generates an operation instruction signal for the electromagnetic brake 52 and stops the revolution of the feed roller 18. In consequence, the trailing end portion 11*a* of the preceding tube 11 stops at the predetermined position of the left-hand tube holding plate 31 as illustrated in FIG. 2 in conjunction with FIG. 3. At this time, the second counter 55 also generates an advance operation instruction signal of the right-hand air cylinder AC2 and while advancing the right-hand tube holding plate 32, it opens the first vacuum valve in order to create a vacuum in the suction holes 33 on the front surface of the left-hand tube holding plate 31. The trailing end portion 11*a* of the preceding tube 11 is then drawn and held to the front surface of the left-hand holding plate 31, the left-hand holding plate 31 is then coupled with the right-hand tube holding plate 32, thereby completing splicing between the new and old tubes.

Both vacuum valves are closed upon completion of splicing and the negative pressure of the suction holes 33, 34 is released. The right-hand air cylinder AC2 then starts retreating, and high speed revolution of the main motor and the feed motor 50 is resumed.

The abovementioned operation is effected alternately for the right and left tube feed paths and splicing of the new and old tubes may be effected repeatedly. In the interim, the feed of the tube to the cutting step is continuous.

When opaque patterns are printed repeatedly on a tape made of a transparent material, the third photoelectric conversion switch PS3 is a transmission type. If a color difference in the opaque patterns is to be detected, the third photoelectric conversion switch PS3 is a reflection type.

In accordance with the present invention having the above-described construction and action, reference for positioning the old and new tapes or tubes to be spliced so that the patterns in the longitudinal direction of the tapes coincide, is based upon the specific distinction pattern 15 in the patterns that are repeatedly printed with a predetermined pitch. Accordingly, the tapes or tubes can be used fully in the direction of width as an advertising medium. Moreover, since a stored tape is delivered in order not to stop the feed of tape to the cutter even when the feed roller 18 stops at the time of splicing the old and new tapes, the production efficiency can be improved to a marked extent.

What is claimed is:

1. A tape splicer in an automatic continuous tape feeder for splicing tapes including tubular tapes, each of said tapes having patterns repeatedly printed thereon in a predetermined constant pitch and containing, in said pattern a gap of a constant length within each pitch; comprising:

a pair of paths capable of alternately feeding rolls of tapes in appropriate quantities from a pair of reels supporting thereon said rolls of tapes to a common feed roller;

first and second photoelectric conversion switches for detecting the passage of the trailing end portion of each of said tapes, each of said switches disposed in each of said paths in positions upstream of and equidistant from said feed roller;

a pair of tape holding plates disposed outside said pair of paths between said photoelectric conversion switches and said feed roller, respectively, with such a gap between them that the front surfaces thereof are opposed to each other and are capable of joining each other when they undergo displacement towards each other;

each of said tape holding plates having vacuum suction holes bored on the front surface thereof for drawing and holding said tapes thereon in a waiting state at predetermined positions in the direction of width and with predetermined positions in the longitudinal direction in order to splice the leading end portion of the succeeding tape pulled out from one of said reels to the trailing end portion of the preceding tape pulled from the other of said reels;

a third photoelectric conversion switch for detecting said patterns of said tapes, disposed between said tape holding plates and said feed roller;

a rocking roller disposed downstream of said feed roller, suspended by said tapes stretched between two guide rollers, having both axial end portions thereof disposed movably in vertical direction along guide frames and capable of rising against gravity to feed stored tape in the downstream direction when said feed roller stops rotating and tension is applied to said tape;

a driving motor for said feed roller capable of being changed over to low speed revolution upon receiving a signal generated when the trailing end portion of the preceding tape pulled out from one of said reels and fed through the one of said paths passes by said first or second photoelectric conversion switch, and returned to high speed revolution upon receiving a signal generated when said tape holding plates withdraw after the completion of tape splicing;

a pulse generator actuated upon receiving said signal generated from said first or second photoelectric conversion switch and generating pulses in such a number as to be proportional to a rotational displacement of said feed roller;

a first counter so set as to receive the number of pulses generated from said pulse generator and an ON-OFF signal detected from said third photoelectric conversion switch, and to generate one signal whenever the pulse number corresponding to the gap of said pattern is counted;

a second counter set so as to receive the signal generated from said first counter and to generate a signal instructing the stop of said feed roller and a signal to instruct the advance and joining of said pair of tape holding plates when a number of pulses equal to the number of pitches corresponding to the distance between the set position of said first or second photoelectric conversion switch and the set position of said pair of tape holding plates are counted.

2. A tape splicer as defined in claim 1 comprising a transmission type switch as said third photoelectric conversion switch.

3. A tape splicer as defined in claim 1 comprising a reflection type switch as said third photoelectric conversion switch.

4. A tape splicer as defined in claim 1 which includes means for feeding said tape in a suitable quantity, said means having a construction such that said rocking roller is suspended by said tape stretched between said two guide rollers; both axial portions of said rocking roller being disposed movable in the vertical direction along said guide frames, a proximity switch being disposed at the lower limit position of said rocking roller, and said proximity switch being actuated whenever tension is applied to said tape and said rocking roll undergoes displacement in the rising direction against gravity, thereby actuating an electromagnetic clutch interposed in a power transmission system of a motor for driving and rotating said reels.

5. A tape splicer as defined in claim 1 which includes means for joining said pair of tape holding plates, said means consisting of slider blocks disposed at the base portions of said holding plates; each of said slider blocks so supported as to be capable of undergoing displacement along a common guide rod; and a pair of air cylinders for advancing or withdrawing said pair of slider blocks.

6. A tap splicer as defined in claim 1 which includes means for drawing vacuum in said tape suction holes bored on the front surfaces of said pair of tape holding plates, said means having a construction such that when one of said tape holding plates is at its withdrawn position and said tape is detected by said first or second photoelectric conversion switch disposed on the side thereof, a vacuum valve on said side is opened and when one of said tape holding plates advances simultaneously with the stopping of said feed roller, another vacuum valve disposed on the opposite side is opened; both of said vacuum valves are closed immediately before said pair of tape holding plates start withdrawing upon completion of the splicing operation of the old and new tapes; and when no tape is detected by said first or second photoelectric conversion switch, said vacuum valve on non-detected side is closed.

7. A tape splicer according to claim 1, comprising a pair of slider blocks for detachably supporting said tape holding plates.

* * * * *